United States Patent [19]

Underdue

[11] 4,006,606

[45] Feb. 8, 1977

[54] FREEZING POT

[76] Inventor: Joyce Underdue, 184 Hollywood Ave., East Orange, N.J. 07018

[22] Filed: June 2, 1975

[21] Appl. No.: 582,733

[52] U.S. Cl. ..... 62/449; 62/457

[51] Int. Cl.[2] ..... F25D 19/00; F25D 3/08

[58] Field of Search ..... 62/457, 449

[56] References Cited

UNITED STATES PATENTS

| | | | |
|---|---|---|---|
| 2,433,655 | 12/1947 | Zoppola | 62/449 |
| 2,496,492 | 2/1950 | Prosek | 62/449 |
| 2,671,603 | 3/1954 | Bauer | 62/449 |
| 2,734,351 | 2/1956 | Stewart | 62/457 |
| 2,880,596 | 4/1959 | Brown et al. | 62/457 |
| 3,347,060 | 10/1967 | Barkan | 62/457 |
| 3,410,109 | 11/1968 | Maryland | 62/457 |
| 3,605,431 | 9/1969 | Carson | 62/457 |

*Primary Examiner*—Lloyd L. King
*Attorney, Agent, or Firm*—Richard L. Miller

[57] ABSTRACT

A portable, insulated container cooled by a small refrigeration system contained therebeneath and including a battery driven motor for operating a compressor and other components of the refrigerator system which includes cooling coils located inside the container; the container being readily placable along side of a bed of a patient or other person so that he can help himself conveniently to cold milk, refrigerated medication, and the like.

1 Claim, 3 Drawing Figures

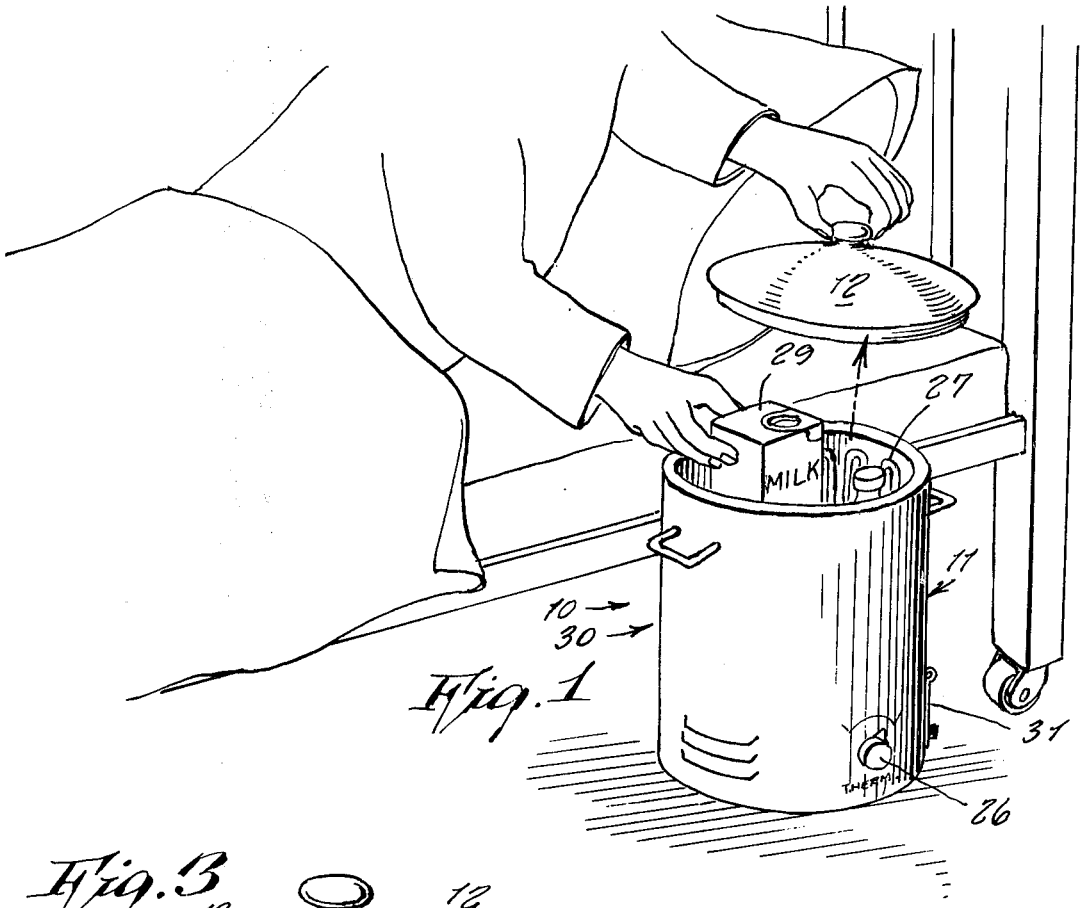
Fig. 1
Fig. 3
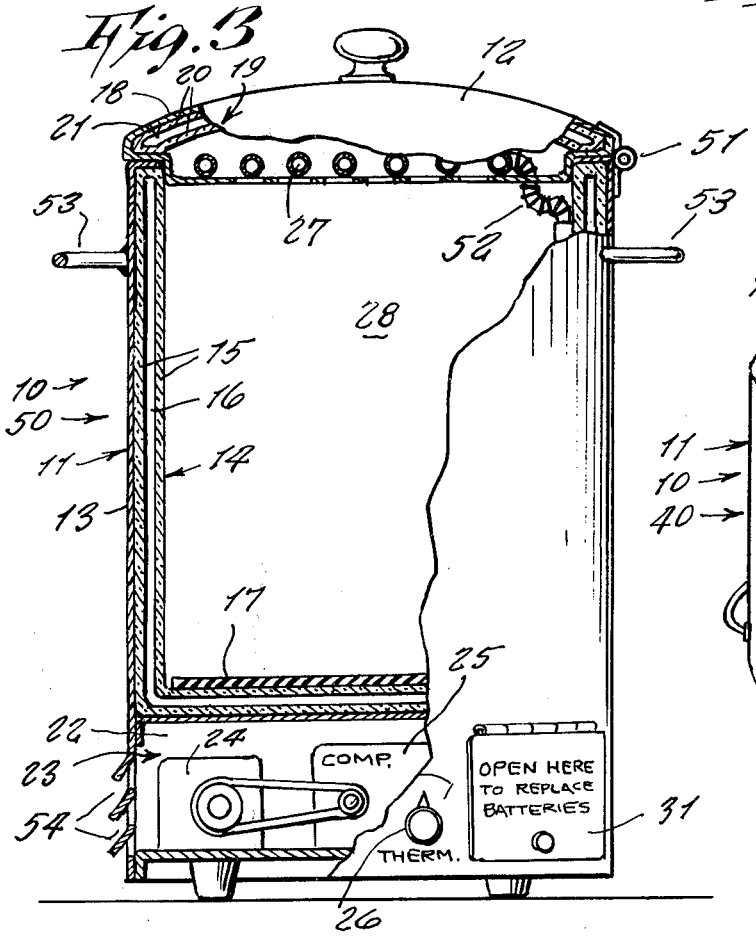
Fig. 2
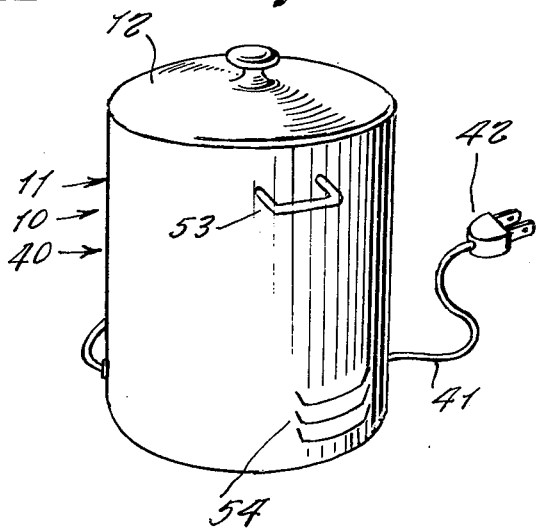

FREEZING POT

This invention relates generally to portable refrigerators.

A principal object of the present invention is to provide a miniature refrigerator that can be easily carried and placed alongside of a bed so that a person resting therein has a convenient access to cold drinks, food, other refrigerated items without need of getting out of bed to go to a kitchen for the same, or have someone else to bring it to him.

Another object accordingly, is to provide a freezing pot which would be ideal for hospital patients such as ulcer sufferers who are obliged to drink milk frequently, so that they could help themselves to cold milk from the freeze pot whenever needed without waiting for the service of a nurse who may not be always available.

Another object is to provide a freeze pot that would be useful to chronically ill patients who require medication that must be refrigerated, or who wish to have refreshing cold ice water to drink.

Still another object is to provide a freeze pot that would be useful in hotel rooms for keeping ice and cold drinks as well as foods, or for use by honeymooners to keep their champagne cold.

Still a further object is to provide a freeze pot for use in a bedroom at home for late T.V. watchers to take a snack or drink beer without need to wait for commercial times to get out of bed and go to the kitchen.

Other objects are to provide a freeze pot which is simple in design inexpensive to manufacture, rugged in construction, easy to use and efficient in operation.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

FIG. 1 is a perspective view of a battery operated model of the invention, shown in use.

FIG. 2 is a perspective view of a model thereof which is operated by household electric current.

FIG. 3 is an enlarged cross sectional view of a modified design thereof.

Referring now to the drawing in detail, the reference numeral 10 represents a freezing pot according to the present invention wherein there is a cylindrical upright container 11 that is open on top and is closable by a lid 12.

The container consists of an outer sheath 13 made of metal such as either aluminum or copper having a fibreglass insulation 14 on its inner side consisting of double walls 15 with a central insulation space 16 therebetween, and which extends around the side and bottom of the container. A resilient rubber pad 17 may be placed upon the bottom so to cushion the placement of items downwardly into the container.

The lid 12 is likewise made of a metal sheath 18 with fibreglass insulation 19 inside formed with double walls 20 and air space 21.

In the present invention a compartment 22 is formed underneath the container 11 for containing a refrigerating mechanism 23 that includes an electric motor 24, compressor 25, evaporator (not shown) and other components of a conventional refrigeration system, together with a manually controlled thermostat 26. The mechanism also includes cooling coils 27 that extend into the interior in order to keep cold a milk carton 29 or other items placed into the container.

In FIG. 1, a model 30 of the invention is shown wherein the lid is removable, and the cooling coils 27 are located around the side of the interior. Also the compartment 22 includes an access door 31 for purpose of easily replacing dry cell batteries that are used to power the motor.

In FIG. 2, the model 40 of the invention is the same as model 30 except that instead of being battery powered, the motor is powered by household electricity, so that an extension cord 41 fitted with mail plug 42 extends from the freezing pot so to be connected to any handy household electric outlet socket.

In FIG. 3, another model 50 of the invention is the same as model 30 except that the lid is pivotally attached by hinge 51 to the container, and the cooling coils are located on the underside of the lid so that the cooling is most effective to everything that is located therebelow. A flexible hose 52 between the coils 27 and the remainder of the refrigeration mechanism is provided so to flex when the hinge is pivoted, the hose 52 comprising a steel woven mesh imbedded within a rubber casing, similar to hydraulic hose.

Thus different models of the invention are provided. All include convenient carrying handles 53, and lowered openings 54 are provided to cool off the compartment 22 from the motor heat.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. In a freezing pot, the combination of a container having an access opening at its top, a removable lid on said opening, said lid and container each being comprised of a metal outer sheath having a fibreglass insulation on their inner sides so to form an insulated interior within said freezing pot, each said insulation comprising a singular unit that includes double walls with a central insulation space therebetween, said container insulation extending around the side and bottom of said container, a resilient rubber pad placed on top said insulation bottom so to cushion the placement of items downwardly into said container, a plurality of carrying handles on an outer side of said container, a compartment below said container containing a refrigeration mechanism including an electric motor driving a compressor, an evaporator and other conventional refrigeration components, and electric power means to said motor, said lid being hingedly connected to said container, a cooling coils of said mechanism being located on an underside of said lid, a horizontal member, integral with said lid sheath, is on an underside of said coil and being provided with openings therethrough for allowing cooled air from said coil flow downward into said container interior, and a flexible hose extending between said coil and a remainder of said mechanism in said compartment below said container, said hose comprising a steel-woven mesh imbedded within a rubber casing.

* * * * *